US006229104B1

(12) United States Patent
Matsui

(10) Patent No.: US 6,229,104 B1
(45) Date of Patent: May 8, 2001

(54) COMPOSITE SWITCH FOR ELECTRONIC APPARATUS

(75) Inventor: Tsuyoshi Matsui, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/363,935

(22) Filed: Jul. 30, 1999

(30) Foreign Application Priority Data

Aug. 4, 1998 (JP) ..... 10-220217

(51) Int. Cl.[7] ..... H01H 9/00

(52) U.S. Cl. ..... 200/4; 200/5 R; 200/18; 200/302.1

(58) Field of Search ..... 200/11 R, 11 TW, 200/402–434, 512, 520–551, 4, 5 R, 6 A–6 B, 18, 453, 302.1–302.3, 5 A

(56) References Cited

U.S. PATENT DOCUMENTS

| | | | | |
|---|---|---|---|---|
| 3,419,684 | | 12/1968 | Lord et al. | 179/99 |
| 3,493,696 | | 2/1970 | Rothweiler | 200/4 |
| 3,619,519 | * | 11/1971 | Wiggins | 200/4 |
| 3,863,040 | * | 1/1975 | Van Benschoten et al. | 200/453 |
| 4,186,284 | | 1/1980 | Strachan | 200/14 |
| 5,416,970 | * | 5/1995 | Kadlubowski | 200/302.1 |
| 5,665,946 | * | 9/1997 | Nishijima et al. | 200/4 |
| 5,705,778 | * | 1/1998 | Matsui et al. | 200/11 R |
| 5,847,335 | * | 12/1998 | Sugahara et al. | 200/4 |
| 5,959,267 | * | 9/1999 | Kawasaki et al. | 200/4 |
| 6,049,044 | * | 4/2000 | Mizobuchi | 200/4 |

FOREIGN PATENT DOCUMENTS 0717424 6/1996 (EP) .

* cited by examiner

*Primary Examiner*—J. R. Scott
(74) *Attorney, Agent, or Firm*—Adams & Wilks

(57) ABSTRACT

A composite switch utilizing a single button to perform two or more switching functions including a rotational direction switch operation and a push-button switch operation. Rotational movement of the button elastically deforms a first contact spring by a rotation of a cam fixed to the button via a button shaft so as to connect the contact spring to a first electrode. Axial movement (push-button operation) elastically deforms a second contact spring provided at a lower end portion of the button shaft in response to a pressing down operation of the button so as to connect the second contact spring to a second electrode. A rotational direction returning spring and a pressing down direction returning spring are provided in an inner portion of the button for biasing the button in a neutral position and automatically returning the button to the neutral position. A waterproof packing is slidably disposed between the button shaft and a case in which the switches and button shaft are disposed. To avoid erroneous operation of the switch function, the switch is configured so that a pressing down operation of the button can not be performed while a rotating operation of the button is being performed.

18 Claims, 7 Drawing Sheets

COMPOSITE SWITCH FOR ELECTRONIC APPARATUS

BACKGROUND OF THE INVENTION

1. Field of the Invention

The present invention relates to a composite switch for an electronic apparatus having a plurality of switch functions in one switch mechanism.

2. Description of the prior Art

In a conventional switch, in order to obtain a plurality of switch functions, a rotational direction switch and a pressing down direction switch are separately and independently provided, respectively.

For example, at the time of an input operation for inputting information in a portable information apparatus, in order to select letters and symbols to be input and corrected, the number of switches for moving a cursor must be at least three switches comprising two switches for searching forward and searching rearward and, a switch for determining a letter and, or a symbol to be input and corrected, so that it is necessary to frequently switch fingers at each time of operation. Further, the frequency is of this increased as the amount of information to be input and corrected is increased.

In the structure of the conventional switch, since the moving direction of the switch is different between the rotational direction and the pressing down direction, it is unavoidable that separate switches for each independently exist. Accordingly, it is troublesome to switch the fingers and it is complex to operate the button. Further, there is the problem that a restriction in the design of a product is increased due to the need to include a plurality of buttons.

SUMMARY OF THE INVENTION

In order to solve the problems mentioned above, in accordance with a switch mechanism of the present invention, a switch provided which is structured such that a switch operation in a rotational direction is obtained by elastically deforming a contact spring by a cam fixed in such a manner as to follow to a button shaft so as to connect the contact spring to an electrode. Further, the switch is structured such that a switch operation in a pressing down direction is obtained by elastically deforming a contact spring provided at a lower end portion of the button shaft by pressing down the button so as to connect the contact spring to the electrode. Still further, the switch is structured such that a rotational direction returning spring and a pressing down direction returning spring are provided in an inner portion of the button, thereby automatically returning the button to a predetermined position.

Further, the switch is structured such that a waterproof packing is provided in a sliding portion between the button shaft and a case corresponding to a holding member of the button (hereinafter, refer red to as a case), thereby providing a water proof performance.

Still further, in order to avoid an erroneous operation of the switch function, the switch is structured such that the pressing down of the button can not be performed at a time of the rotating operation of the button.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
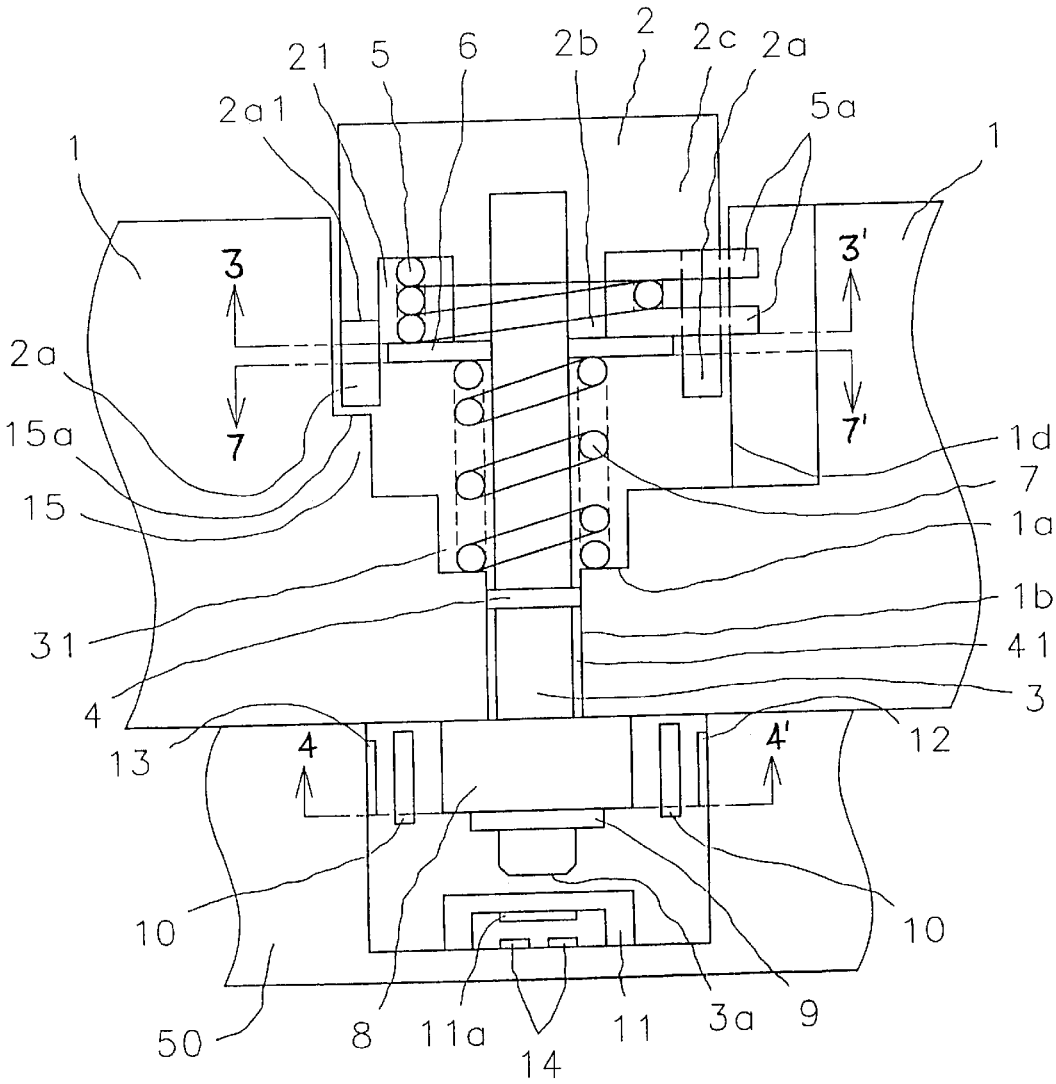
FIG. 1 is a cross sectional view of a normal state of a composite switch for an electronic apparatus.

The invention is structured such that a button (2) rotating or vertically moving in accordance with a movement of a user's finger is provided in an upper portion of one button shaft (3), a rotation returning spring (5) and a pressing down returning spring (7) are provided in an inner portion of the button (2), and a waterproof packing (4) is provided in a sliding portion between the button shaft (3) and a case (1). The switch is structured such that a cam (8) is fixed to a lower end portion of the button shaft (3) and an upper surface of the cam (8) is brought into contact with an inner surface of the case (1) so as to receive a spring force of the pressing down returning spring (7). Rotational direction contact springs (10, 10) and rotating switch electrodes (12, 13) are provided in an outer side of the cam (8), whereby the rotational direction contact springs (10, 10) are elastically deformed due to a rotation of the cam (8) in accordance with the rotation of the button shaft (3) so as to be connected to the rotating switch electrodes (12, 13), and a pressing down direction contact spring (11) elastically deforming due to a vertical motion of the button shaft (3) and the pressing down switch electrode. (14) are provided in a lower end portion of the button shaft (3).

Further, the structure is provided such that at a time of rotating the button, a lower surface **(2*a*1) of an outer wall (2*a*) of the button comes close to an upper surface (15*a*) of a button receiving table (15) provided in the case (1)** so as to be layered in a plane manner to prevent a pressing down operation of the button during a rotational movement thereof.

An embodiment will be described below with reference to the accompanying drawings. In FIG. 1, a rotation returning spring (5) is mounted to an inner portion of a button (2). A groove (21)capable of receiving the rotation returning spring (5) at this time is defined in the inner portion of the button (2) by a button outer wall **(2*a*), a button inner wall (2*b*) and a button top wall (2*c*). The rotation returning spring (5) is mounted to the groove (21) using the button shaft (3) as a guide, and a seat (6) is brought into contact with the lower surface of the button inner wall (2*b*)** using the button shaft (3) as a guide within the groove (21), thereby pressing as a receiving member for the rotation returning spring (5).

Next, after setting the pressing down returning spring (7) using the button shaft (3) as a guide, the pressing down returning spring (7) is inserted to a recess portion (31) of the case (1). At this time, the pressing down returning spring (7) is held between the receiving surface (1*a*) of the pressing down returning spring (7) of the case (1) and the seat (6) with a spring characteristic in an axial direction.

The upper surface of the cam (8) fixed to the lower end portion of the button shaft (3) is brought into contact with the inner surface of the case (1) and receives a reaction force of the pressing down returning spring (7), thereby securing a normal position of the button (2). A water proof packing (4) is previously assembled at a predetermined position in the button shaft (3). The water proof packing (4) elastically deforms with respect to an inner wall (1*b*) of a through hole (41) of the case (1) so as to become slidable, thereby securing a water proof performance.

Figure 4:
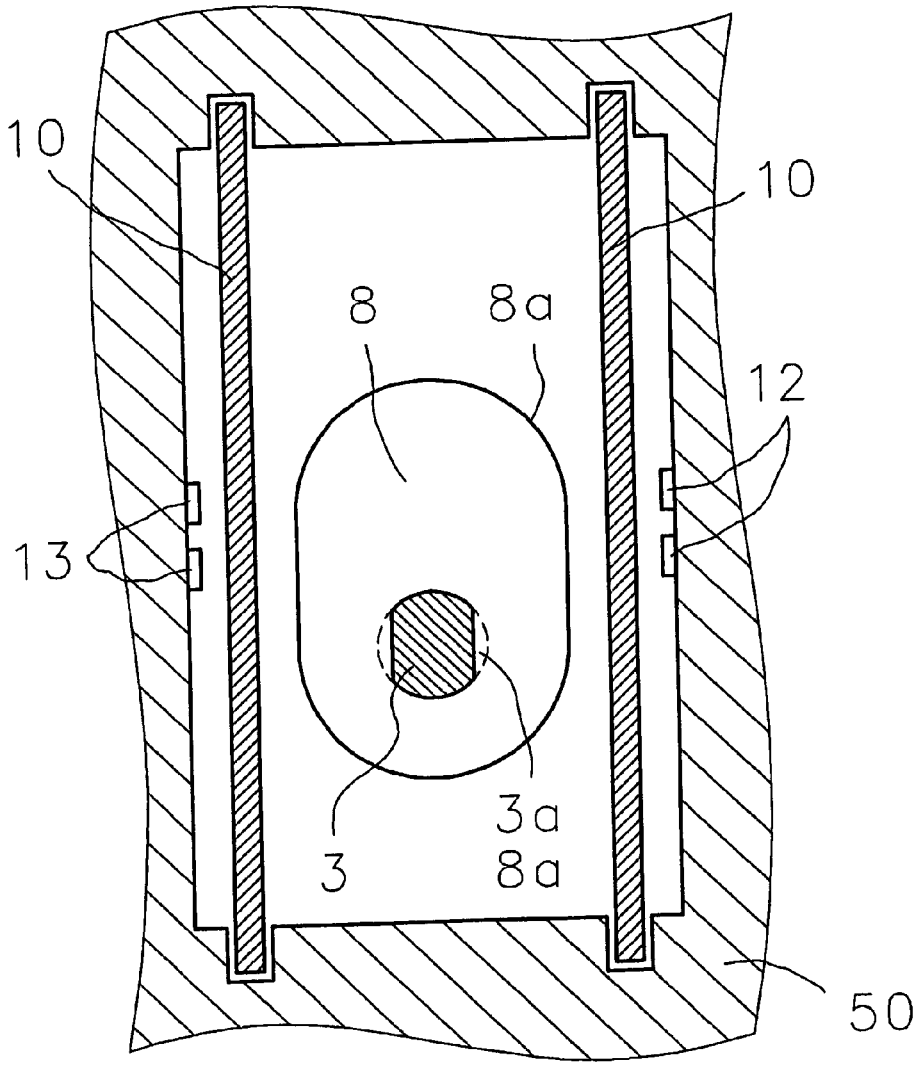
FIG. 4 is a cross sectional view as seen from a line 4–4' in FIG. 1 which shows the normal state of the cam portion in the composite switch for the electronic apparatus.

FIG. 4 is a cross sectional view as seen from 4–4' in FIG. 1 showing a normal state of a cam portion in the composite switch for the electronic apparatus.

As shown in FIG. 4, a cam (8) formed in an oval shape is eccentrically inserted and fixed to a front end portion of the button shaft (3) inserted after passing through the case (1). That is, a notch (3*a*) is provided in an insertion portion of the cam (8) at the front end of the button shaft (3) as shown in FIG. 4 and a rectangular hole (8*a*) of the cam is engaged therewith in correspondence to a shape of the notch (3*a*), whereby the cam (8) follows a rotational motion of the button shaft (3) and can be rotated. After inserting the cam (8) to the front end portion of the button shaft (3), the cam (8) is fixed by an E ring (9) near the front end of the button shaft (3), as shown in FIG. 1.

As shown in FIGS. 1 and 4, rotational direction contact springs (10, 10) supporting both ends to the module (50) of the electronic apparatus and mounted as a both end supporting beam are arranged at both sides of the cam (8) in an inner portion of the case (1), and a pair of rightward rotation switching electrodes (12) mounted on a wall surface of the module (50) and a pair of leftward rotation switching electrodes (13) are arranged at an outer side thereof. Further, as shown in FIG. 1, the pressing down direction contact springs (11) respectively mounted to the module (50) are arranged in a lower portion of the front end (3*a*) of the button shaft (3) positioned below the cam (8), and a pair of pressing down switching electrodes (14) are arranged in a further lower portion.

In this case, the pressing down direction contact spring (11) is formed by an insulative elastic rubber, and a conductive sheet (11*a*) opposing to the pressing down switch electrode (14) is provided on the lower surface.

Figure 2:
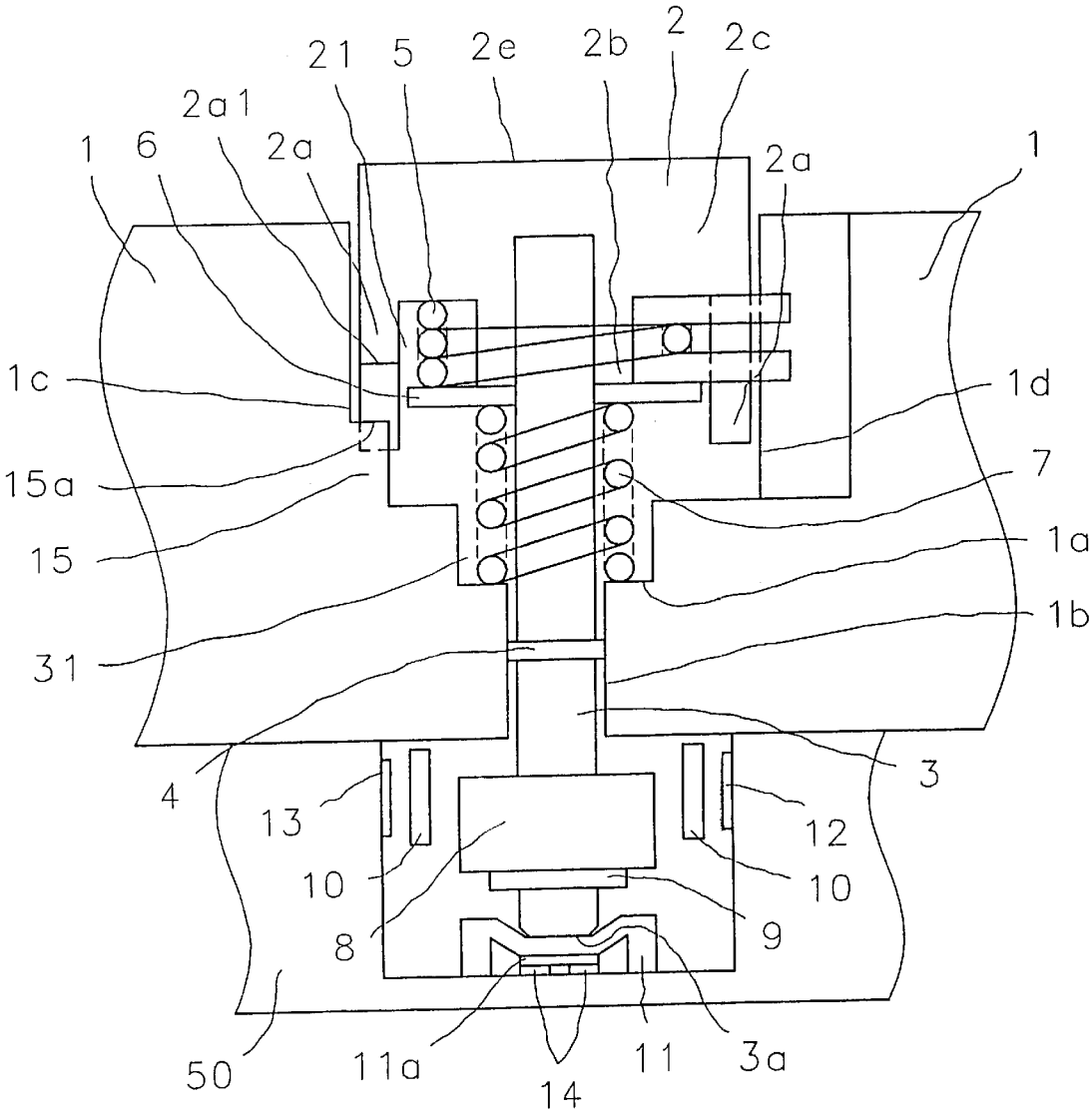
FIG. 2 is a cross sectional view which shows a state of pressing down the composite switch for the electronic apparatus.

FIG. 2 is a cross sectional view at a time of a pressing down operation of the button (2). When pressing down an upper surface (2*e*) of the button (2) by the user's fingers, the pressed down button shaft (3) elastically deforms and presses down the pressing down direction contact spring (11) placed below the lower portion of the cam (8), and further connects a pair of pressing down switch electrodes (14) arranged in the lower portion to the conductive sheet (11*a*), so that the switch is turned on.

Thereafter, when releasing the fingers from the button (2), the button (2) is automatically returned to an original position shown in FIG. 1 due to a restoring or biasing force of the pressing down returning spring (7) compressed by the pressing down operation.

Further, the pressing down direction contact spring (11) is also returned to an original position shown in FIG. 1 due to an elastic restoring force of the pressing down direction contact spring (11) itself.

Figure 3:
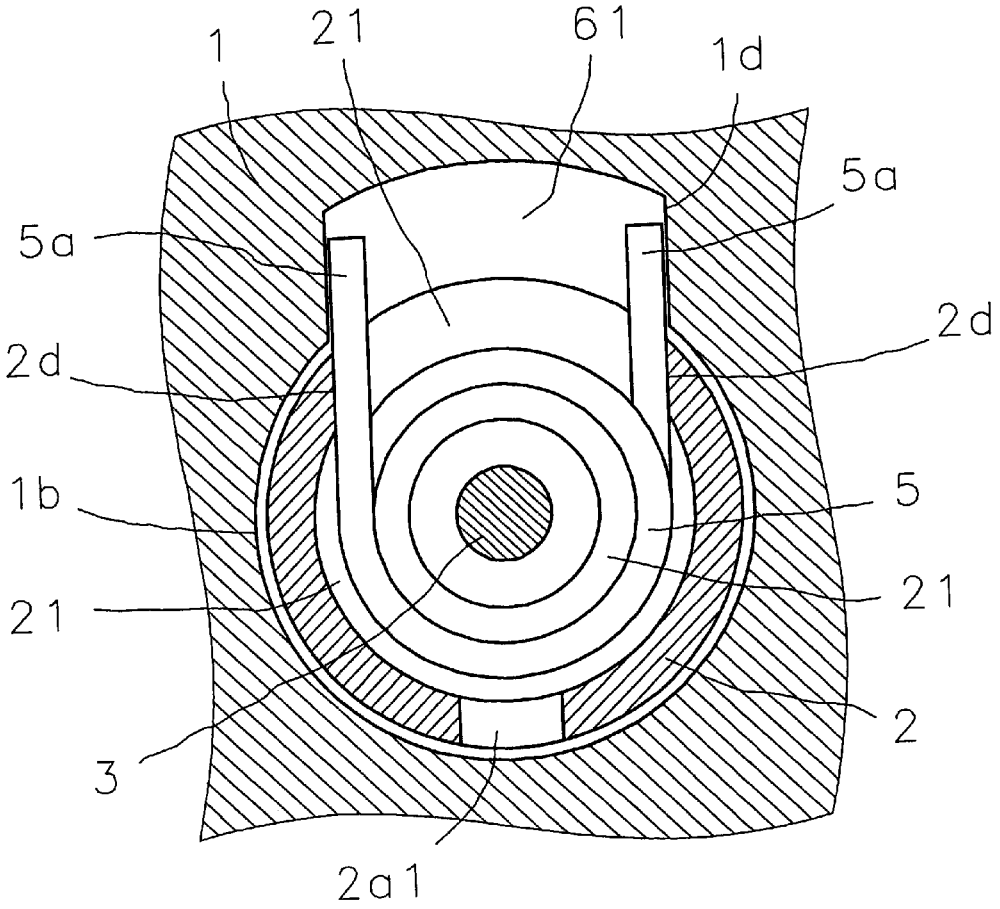
FIG. 3 is a cross sectional view as seen from a line 3–3' in FIG. 1 which shows the normal state of the composite switch for the electronic apparatus.

A receiving state of the rotation returning spring (5) mounted to the inner portion of the button (2) is shown in FIGS. 1 and 3.

At this time, both ends (5*a*) of the rotation returning spring (5) receive a releasing force of the spring on a spring locking surface (2*d*) of the button (2) and are received in a groove (21) of the button (2), and front ends of the both ends (5*a*) of the rotation returning spring (5) are arranged and assembled within a space portion (61) of the case (1).

In a series of operations, the rotation returning spring (5) is pressed in an upward direction of the inner portion of the button (2) due to a press insertion of the seat (6) and follows a vertical motion of the button (2).

FIG. 3 is a cross sectional view as seen from a line 3–3' in FIG. 1 in a normal state of the button (2), and shows a neutral position of the button (2).

Figure 5:
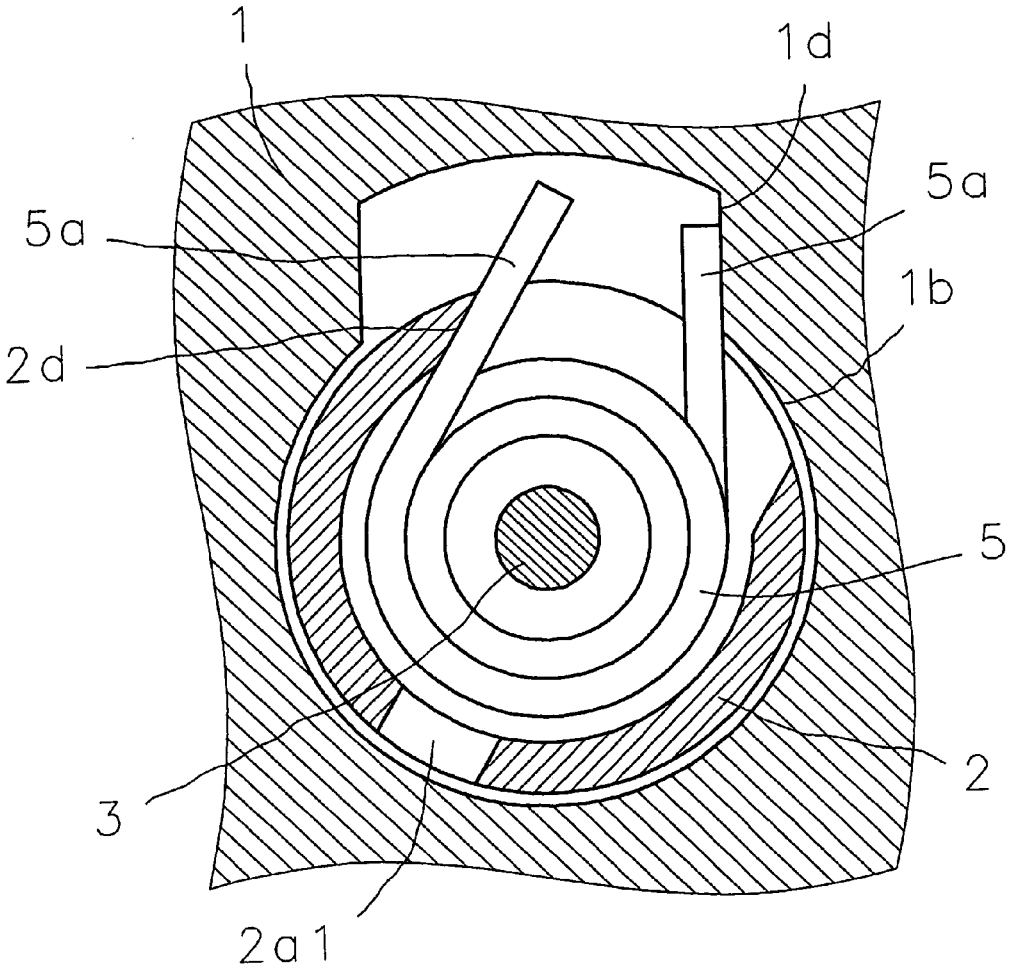
FIG. 5 is a cross sectional view as seen from a line 3–3' in FIG. 1 which shows a state at a time of a rotating operation of the composite switch for the electronic apparatus.

FIG. 5 is a cross sectional view as seen from a line 3–3' in FIG. 1 which shows a state of the rotation returning spring (5) disposed in the inner portion of the button (2) at a time of a rightward rotating operation of the button (2). When the button (2) rotates in a rightward direction from the position shown in FIG. 3 showing a neutral position, an end portion (5*a*) of the rotation returning spring (5) is locked with the spring lock surface (1*d*) of the case (1), and the other end portion (5*a*) of the rotation returning spring (5) receives a rotational force from the spring lock surface (2*d*) of the button (2) and rotates to a predetermined position.

Figure 6:
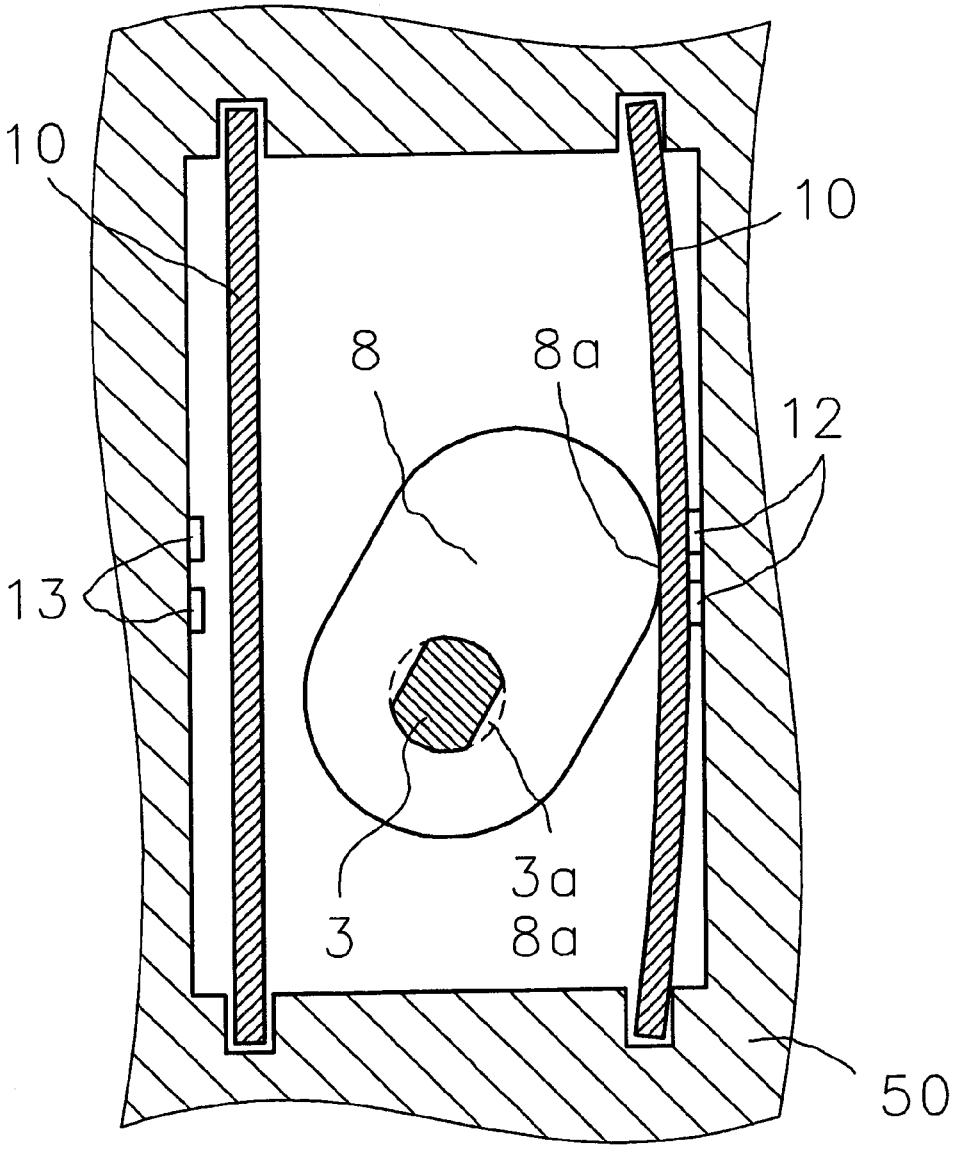
FIG. 6 is a cross sectional view as seen from a line 4–4' in FIG. 1 which shows a state of the cam portion at a time of the rotating operation of the composite switch for the electronic apparatus.

At this time, the cam (8) rotates in a rightward direction from a neutral position shown in FIG. 4 so as to be in a state shown in FIG. 6, and a part (8*a*) of the outer shape of the cam (8) is pressed to the rotational direction contact spring (10).

FIG. 6 is a cross sectional view of the cam (8) portion as seen from a line 4–4' in FIG. 1 when the button (2) is rotated in a rightward direction. That is, generally explaining, the button shaft (3) rotated in an optional direction by the rotating operation of the fingers rotates the cam (8) placed in such a manner as to follow to the rotation of the button shaft (3), elastically deforms the rotational direction contact spring (10) arranged in both sides of the cam (8) so as to press down, and further the rotational direction contact spring (10) is connected to a pair of rightward rotation switching electrodes (12) arranged in the outer side thereof or a pair of leftward rotation switching electrodes (13), so that the switch is turned on.

Thereafter, when releasing the fingers from the button (2), the button (2) is automatically returned to the neutral position shown in FIG. 3 due to a reaction force of the rotation returning spring (5) deformed by the spring lock surface (2*d*) disposed in the inner portion of the button and the spring lock surface (1*d*) of the case by the rotating operation.

Further, the rotational direction contact spring (10) is returned to the original position shown in FIG. 3 due to an elastic restoring force of the rotational direction contact spring (10) itself.

A description will be given of a structure for preventing an erroneous operation in the switch function at a time of the rotating operation of the composite switch for the electronic apparatus with reference to FIGS. 7A and 7B.

Figure 7A:
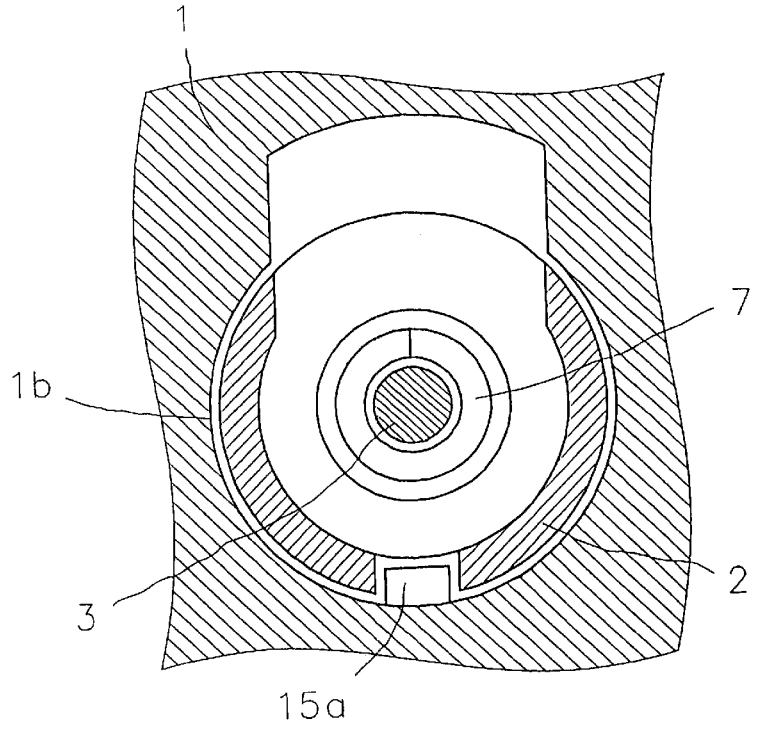
FIG. 7A is a cross sectional view as seen from a line 7–7' in FIG. 1 which shows the normal state of the composite switch for the electronic apparatus.

FIG. 7A is a cross sectional view as seen from a line 7–7' in FIG. 1 which shows a normal state of the composite switch for the electronic apparatus.

Figure 7B:
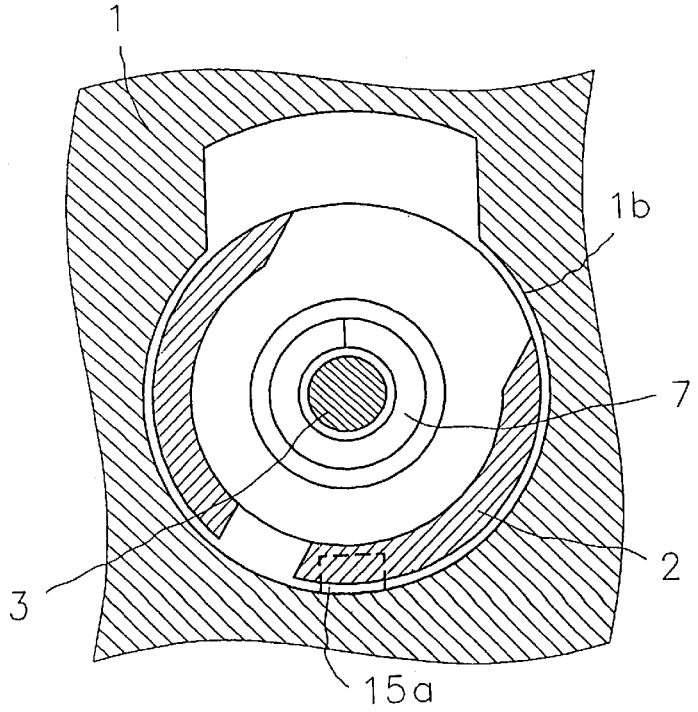
FIG. 7B is a cross sectional view as seen from a line 7–7' in FIG. 1 at a time of the rotating operation of the composite switch for the electronic apparatus.

FIG. 7B is a cross sectional view as seen from a line 7–4' in FIG. 1 at a time of a rotating operation of the composite switch for the electronic apparatus.

The structure is made such that at a time of the rotating operation of the button (2), a lower surface (2*a*1) of an outer wall (2*a*) of the button comes close to an upper surface (15*a*) of a button receiving table (15) provided in the case (1) so as to be layered in a plane manner, and so as not to be layered in a plane manner in the normal state of the button (2).

In the structure described above, the switch is made such that even when a pressing down force is accidentally applied at a time of the rotating operation of the button (2), the lower surface (2*a*1) of the outer wall (2*a*) of the button (2) is brought into contact with an upper surface (15*a*) of the button receiving table (15).

The invention is embodied an aspect described above, and the following effects can be obtained.

Since the apparatus is made compact and a waterproof structure can be realized by providing the rotation returning spring (5), the seat (6), the button (2) for receiving the pressing down returning spring (7), the waterproof packing (4) and the cam (8) on the axis of one button shaft (3), a product design is not limited and a compact and advantageous design can be performed.

Further, since the structure is made such that it is impossible to press down the button at a time of the rotating operation of the button and the rotating operation and the pressing down operation can be performed by one button, an erroneous operation of the switch function is prevented and it is unnecessary to replace the fingers, so that an operation can be easily and securely performed.

Since the button (2) is always automatically returned to the neutral position by the rotation returning spring (5) and the button (2) is always automatically returned to the predetermined position by the pressing down returning spring (7), the operation of the button can be easily performed.

What is claimed is:

1. A composite switch for an electronic apparatus, comprising: a case for housing a plurality of switches for activating an electronic apparatus; a button shaft axially supported in a slidable manner in a through hole extending from an outer portion of the case toward an inner portion thereof in which the switches are contained; a button fixed to an outer end portion of the button shaft and extending to an outer portion of the case; a rotatable cam disposed inside the case and engaged with an inner end portion of the button shaft to undergo rotational movement therewith; and a plurality of switch electrodes disposed in the case and being activated in response to axial and rotational movement of the button shaft; wherein the button shaft comes into contact with first switch electrodes in response to axial movement of the button to perform a first switch function, and the button shaft comes into contact with second switch electrodes in response to rotational movement of the button to perform a second switch function so that two independent switch functions can be performed using a single button.

2. A composite switch for an electronic apparatus according to claim 1; wherein the slidably axial support of the button shaft in the through hole of the case includes a waterproof packing disposed between the button shaft and the through hole.

3. A composite switch for an electronic apparatus according to claim 1; further comprising a rotation returning spring received within the button for applying a biasing force against rotational movement of the button and the button shaft, and a pressing down returning spring for applying a biasing force against axial pressing down movement of the button and the button shaft and being received in a periphery of the button shaft between the case and the button, to thereby provide the first switch function of turning on a pressing down switch electrode mounted to the module via a front end of the button shaft opposite the button in response to a pressing down operation of the button and turning off the pressing down switch electrode when the pressing down operation is stopped and the button is returned to an extended position out of contact with the pressing down switch electrode by the pressing down returning spring, and to provide the second switch function of turning on the rotating switch electrodes mounted on the module by the cam in accordance with rotation of the button in response to rotational operation of the button and turning off the rotating switch electrodes being turned off when the rotational operation of the button is stopped and the button is returned to a rest position out of contact with the rotating switch electrodes by the rotation returning spring.

4. A composite switch for an electronic apparatus according to claim 1; further comprising a rotation returning spring received within the button for applying a biasing force against rotational movement of the button and a pressing down returning spring for applying a biasing force against an axial pressing down movement of the button and the button shaft and being received in a periphery of the button shaft between the case and the button, to thereby provide the first switch function of turning on a pressing down switch electrode mounted to the module via a front end of the button shaft opposite the button in response to a pressing down operation of the button and turning off the pressing down switch electrode when the pressing down operation is stopped and the button is returned to an extended position out of contact with the pressing down switch electrode by the pressing down returning spring, and to provide the second switch function of turning on the rotating switch electrodes mounted on the module by the cam in clockwise and counterclockwise directions in accordance with the clockwise and counterclockwise rotation of the button, so that rotating switch electrodes mounted on the module are turned on and a turning off operation consisting of the electrodes being turned off when the rotation of the button is stopped and the button is returned to a rest position out of contact with the rotating switch electrodes by the rotation returning spring.

5. A composite switch for an electronic apparatus according to any one of claims 3 and 4; further comprising a pressing down direction contact spring having a conductive member opposing the pressing down switch electrode arranged between the front end of the button shaft and the pressing down switch electrode mounted to the module so that downward axial movement of the button causes the conductive member of the pressing down direction contact spring to contact the pressing down switch electrode to activate a function of the electronic apparatus, and a rotational direction contact spring arranged between the cam and the rotating switch electrodes mounted to the module so that rotational movement of the button causes the rotational direction contact spring to contact a rotating switch electrode to activate a function of the electronic apparatus.

6. A composite switch for an electronic apparatus according to any one of claims 3 and 4; wherein opposite ends of the rotation returning spring are disposed against spring lock projections formed in the button and spring lock surfaces formed in the case so that the button shaft is oriented at a neutral position out of contact with the rotating switch electrodes when the button is not undergoing rotational movement, and the rotation returning spring is received within a groove formed in the button, wherein during rotation of the button only one end of the rotation returning spring is disposed against one of the spring lock surfaces formed in the case and the other end of the rotation returning spring is disposed against one of the spring lock projections formed in the button so that the cam which rotates in accordance with rotation of the button shaft is kept out of contact with rotational direction contact springs arranged between the cam and the rotating switch electrodes at a neutral position when the button is not undergoing a rotating operation and and at a time of a rotating operation of the button, the cam is pressed to the rotational direction contact springs and brought into contact with the rotating switch electrodes mounted to the module, whereby the rotating switch electrodes are turned on.

7. A composite switch for an electronic apparatus according to any one of claims 3 or 4; further comprising a button-receiving projection formed inside the case and disposed so that during a rotating operation of the button, a lower surface of an outer wall of the button opposes the button-receiving projection to prevent axial movement of the button during rotational movement of the button, and the button-receiving projection does not oppose the lower surface of the outer wall of the button when the button is not undergoing rotational movement to allow axial movement of the button.

8. A composite switch for an electronic apparatus according to claim 5; wherein a rotating switch electrode and a rotational direction contact spring are arranged at each side of the rotating shaft between the cam and the rotating switch electrodes so that rotational movement of the button in either of a clockwise and a counterclockwise direction causes one of the rotational direction contact springs to contact one of the rotating switch electrodes to activate a function of the electronic apparatus.

9. A composite switch for an electronic apparatus according to claim 5; wherein the cam has an oval shape so that rotational movement of the button causes the cam to elastically deform the rotational direction contact spring and contact the rotating switch electrode to close a switch circuit when the button is rotated.

10. A composite switch for an electronic apparatus according to claim 6; wherein the rotation returning spring is contained in the groove formed in the button and by an annular projection formed around the shaft under the button.

11. A composite switch for an electronic apparatus, comprising:

a case for housing a plurality of switches and having a through hole formed therein extending from an inner surface of the case to an outer surface of the case;

a button slidably disposed in the through hole and exposed to the outer surface of the case;

a button shaft disposed in the through hole and having the button fixed to an outer end thereof and a cam fixed to an inner end thereof inside the case so that the button, the button shaft and the cam undergo rotational movement in unison;

a first switch disposed in the case opposite the cam and being activated by rotational motion of the cam; and a second switch disposed in the case opposite the button shaft and being activated by axial motion of the button shaft.

12. A composite switch for an electronic apparatus comprising:

a case for housing a plurality of switches and having a through hole formed therein extending from an inner surface of the case to an outer surface of the case;

a button slidably disposed in the through hole and exposed to the outer surface of the case;

a button shaft disposed in the through hole and having the button fixed to an outer end thereof and a cam fixed to and inner end thereof inside the case so that the button, the button shaft and the cam undergo rotational movement in unison;

a rotation returning spring disposed in the button for applying a biasing force against rotational movement of the button and maintaining the button at a neutral position when the button is not undergoing rotational movement;

a pressing down returning spring disposed on an outer peripheral surface of the button shaft for applying a biasing force against axial movement of the button shaft and maintaining the button shaft at a neutral position when the button is not undergoing axial movement;

a first switch disposed in the case opposite the cam and being activated by rotational motion of the cam; and a second switch disposed in the case opposite the button shaft and being activated by axial motion of the button shaft.

13. A composite switch for an electronic apparatus according to claim 12; wherein the button is mounted to undergo rotational movement in clockwise and counterclockwise directions to activate the first switch.

14. A composite switch for an electronic apparatus according to claim 12; wherein the rotation returning spring has opposite ends disposed against spring lock projections formed in the button, and the biasing force of the rotation returning spring against rotational force of the button is generated when one of the two end portions of the rotation returning spring is forced against one of the spring lock projections during a rotating operation of the button.

15. A composite switch for an electronic apparatus according to any one of claims 11 and 12; further comprising a waterproof packing slidably disposed between the button shaft and the case.

16. A composite switch for an electronic apparatus according to any one of claims 11 and 12; wherein the second switch comprises a switching electrode and a contact spring having a conductive member opposing the switching electrode, the second switch being activated when the conductive member of the contact spring and the switching electrode are brought into contact in response to an axial pressing down movement of the button, and being deactivated when the axial pressing down movement of the button is stopped.

17. A composite switch for an electronic apparatus according to any one of claims 11 and 12; wherein the first switch comprises a switching electrode and a rotational direction contact spring having a conductive member opposing the switching electrode, the first switch being activated when the conductive member of the rotational direction contact spring and the switching electrode are brought into contact when the cam undergoes rotation, and is deactivated when rotation of the cam is stopped.

18. A composite switch for an electronic apparatus as claimed in any one of claims 11 and 12; further comprising a button-receiving projection formed in the case opposite a lower surface of the button and disposed so that during a rotating operation of the button a lower surface of an outer wall of the button opposes the button-receiving projection to prevent axial movement of the button during rotational movement of the button, and the button-receiving projection does not oppose the lower surface of the button when the button is not undergoing rotational movement to allow axial movement of the button.

* * * * *